US009326589B2

(12) United States Patent
Nakamura et al.

(10) Patent No.: US 9,326,589 B2
(45) Date of Patent: May 3, 2016

(54) BRUSH FOR POWDER COSMETICS

(76) Inventors: Kenji Nakamura, Osaka (JP); Koji Nakamura, Osaka (JP)

( * ) Notice: Subject to any disclaimer, the term of this patent is extended or adjusted under 35 U.S.C. 154(b) by 63 days.

(21) Appl. No.: 13/985,844

(22) PCT Filed: Feb. 16, 2011

(86) PCT No.: PCT/JP2011/053242

§ 371 (c)(1),
(2), (4) Date: Nov. 22, 2013

(87) PCT Pub. No.: WO2012/111106

PCT Pub. Date: Aug. 23, 2012

(65) Prior Publication Data

US 2014/0331428 A1 Nov. 13, 2014

(51) Int. Cl.

| | |
|---|---|
| ***A46B 9/02*** | (2006.01) |
| ***A46B 9/06*** | (2006.01) |
| ***A46D 1/00*** | (2006.01) |

(52) U.S. Cl.

CPC . *A46B 9/021* (2013.01); *A46B 9/06* (2013.01); *A46D 1/0207* (2013.01); *A46D 1/0253* (2013.01)

(58) Field of Classification Search

CPC ..... A46B 9/021; A46B 9/06; A46D 1/0253
USPC ..... 15/160
See application file for complete search history.

(56) References Cited

U.S. PATENT DOCUMENTS 5,195,546 A * 3/1993 Cansler et al. ..... 132/317

FOREIGN PATENT DOCUMENTS

| | | | |
|---|---|---|---|
| JP | 11-235230 | A | 8/1999 |
| JP | 2007-319314 | A | 12/2007 |
| JP | 2009-213562 | A | 9/2009 |

OTHER PUBLICATIONS

International Search Report mailed by Japan Patent Office on Mar. 29, 2011 in the corresponding PCT patent application No. PCT/JP2011/053242.

* cited by examiner

*Primary Examiner* — Shay Karls
(74) *Attorney, Agent, or Firm* — Knobbe, Martens Olson & Bear LLP

(57) ABSTRACT

A brush for powder cosmetics has S strands and Z strands of synthetic fiber hair materials at its tip. The brush for powder cosmetics is characterized in that the twisting pitches of S strands and Z strands at the brush tip part are 10 mm to 30 mm and when the tip of the brush is deflected to trap a cheek color, face powder, powder foundation or other powder cosmetic to be contained in the brush tip part, the powder can be trapped evenly over nearly the entire surfaces at the ends of brush hair materials.

9 Claims, 3 Drawing Sheets

Evaluation standards for powder releasing property:

(Visual comparison of areas where powder is applied and not applied)

5: There is a prominent visible difference

4: There is a clear visible difference

3: There is a visible difference

2: There is a visible difference, although small

1: There is no visible difference

BRUSH FOR POWDER COSMETICS

This application is the U.S. National Phase under 35 U.S.C. §371 of International Application PCT/JP2011/053242, filed Feb. 16, 2011. The International Application was published under PCT Article 21(2) in a language other than English.

TECHNICAL FIELD

The present invention relates to a makeup brush suitable for picking up and trapping powder cosmetics, and also for applying powder.

More specifically, the present invention relates to a makeup brush for powder cosmetics suitable for evenly picking up or trapping from a container a cheek color, face powder, powder foundation, or other powder cosmetic, and also for spreading and applying over the skin surface the powder cosmetic trapped on the surface of brush hairs.

PRIOR ART

In general, makeup brushes whose tip comprises an aggregate of brush hairs called "brush hair materials" are widely used for base makeup, finishing, and touchup. When classified by purposes of use, makeup brushes for face, cheeks, highlight, eye shadow, etc., are widely used not only by general consumers, but also by makeup artists and other beauty professionals.

Using a brush to make up one's face with a powder cosmetic has an advantage in that, unlike when a puff is used, the powder cosmetic can be applied thinly on the skin surface, which makes a brush a superior implement that creates a natural look instead of making an impression of a heavily made-up, powdery face. Also when a brush is used, it is easy to make up only parts of one's face, allowing the user to highlight desired areas of the face according to how the cosmetic material is applied.

For the hair materials of these makeup brushes, goat hair, squirrel hair, horse hair, ferret hair and other animal hairs traditionally have been used. This is partly because these hair materials are soft to the touch, and partly because hairs from these animals have fine surface irregularities called "cuticles" that add a particularly excellent property to trap cheek color, face powder, powder foundation, and other fine powder cosmetics. Once trapped, the powder cosmetic is held by a sufficient amount inside the space between hair materials at the brush tip part and released little by little when applied for makeup, and such characteristic is particularly suitable for so-called gradation, which refers to a technique of applying a thin coat of cosmetic material of natural color close to one's skin. When making up one's face, the user applies the powder cosmetic by spreading it in a thin layer with the tip of the brush contacting the skin surface in stroking motions, at which point animal hairs ensure an appropriate level of flexibility and elasticity and are soft on the skin, which is another reason why animal hairs have been highly appreciated by beauty professionals.

However, hair materials made of these animal hairs not only provide advantages, but they often have unwelcome animal odors and require extra care for storage because they are prone to attachment and breeding of microorganisms, insects, etc., which is hygienically undesirable, and furthermore, brushes using animal hairs may cause skin allergy depending on the user, so various post-processing steps must be added to prevent these unwanted effects. Moreover, recently sentiments of animal protection are growing on a global scale as animals from which hairs are taken are decreasing in number due to a number of environmental reasons such as destruction of nature, climate change, and so on, making it difficult to obtain animal hairs. For these and other reasons, technologies to replace brush hair materials made of animal hairs with monofilaments of synthetic fibers are being developed and put into commercial use.

When straight synthetic fibers manufactured by the standard spinning/extending method are used as brush hair materials, hair materials stick together easily and create fewer voids between hair materials, which leads to poor trapping and retention of powder cosmetics and other limitations on practical use.

Accordingly, various improvement technologies have been proposed, all designed to improve the trapping and retention of powder cosmetics when brush hair materials made of synthetic fibers are used.

For example, Japanese Patent Laid-open No. 2007-319314 (Patent Literature 1) discloses a makeup brush whose tip comprises a mixture of synthetic fiber filaments that have been crimped at a regular pitch, and straight synthetic fiber filaments, to provide voids between hair materials.

In addition, U.S. Pat. No. 5,195,546 (Patent Literature 2) discloses a makeup brush that uses, as its hair materials, synthetic fiber filaments that have been specially crimped at an irregular pitch and amplitude using special gears, etc.

Furthermore, Japanese Patent Laid-open No. Hei 11-235230 (Patent Literature 3) discloses a makeup brush whose hair materials are made of synthetic fiber filaments having a helix structure where strands form a specific pitch by means of heat setting.

PRIOR ART LITERATURES

Patent Literatures

[Patent Literature 1] Japanese Patent Laid-open No. 2007-319314

[Patent Literature 2] U.S. Pat. No. 5,195,546

[Patent Literature 3] Japanese Patent Laid-open No. Hei 11-235230

SUMMARY OF THE INVENTION

Problems to be Solved by the Invention

The technology disclosed in Patent Literature 1 has a brush tip part made by mixing straight synthetic fiber filaments, with synthetic fiber filaments that have been crimped at a regular pitch, at a specific ratio. With this technology, however, forming sufficient voids between the hair material filaments is difficult, and because the brush tip part does not spread sufficiently when a powder cosmetic is trapped, picking up powder evenly over the entire brush tip part is also difficult. As a result, the trapped powder concentrates only on a limited part of the brush tip, and because it is also difficult for the powder to travel deeper into the voids between hair materials, sufficient containment of powder is not possible. This makes it difficult to spread the cosmetic material thinly and evenly over the skin surface, and also the brush that has contacted the skin must be returned to the cosmetic container many times to pick up and trap powder again to replenish powder, which is hygienically undesirable.

According to the technology disclosed in Patent Literature 2, brush hair materials use synthetic fiber filaments that have been crimped to form an irregular pitch and amplitude using special gears. An aggregate of these filaments provides more voids for trapping and retaining powder compared to the aforementioned design, but the flatter crimping limits the formation of voids between hair materials and also the irregular crimp structure means that powder is retained more in some areas and less in other areas, making it easy for the powder to be applied unevenly during makeup and preventing a fine-looking finish.

According to the technology disclosed in Patent Literature 3, the basic problems mentioned above can be solved, but when a general user uses this brush as a face brush or cheek brush and moves its tip on the skin surface in circle-tracing motions, powder is often not applied evenly between when the brush is circled clockwise and when it is circled counterclockwise, which gives rise to a need for training and mastery before the user can apply the powder evenly in a skillful manner. In addition, the tight twisting of hair materials sometimes makes the hair materials feel hard, and manufacturing-wise the small pitch makes hair materials prone to entanglement and difficult to handle in terms of having to separate the entangled hairs. These problems present room for improvement.

In light of the above problems, and after much research, an object of the present invention is to provide a makeup brush for powder cosmetics that ensures excellent manufacturability, provides an excellent property to pick up and trap cheek color, powder foundation, face powder, and other powder cosmetics (hereinafter referred to as "trapping property"), is able to contain powder evenly over the entire brush tip part, and offers an excellent property to retain the powder in the brush tip part once trapped. Furthermore, the makeup brush proposed by the present invention is a makeup brush that releases the powder contained in the brush tip part little by little to be applied on the skin surface (this feature is hereinafter referred to as "releasing property") to give one's makeup a natural finish, and thereby provides superior usability even better than that of animal hair brushes that have traditionally been considered premium products, based on synthetic fiber technology.

In addition, another object of the present invention is to provide a high-grade makeup brush that provides a soft touch when its tip is moved on one's face or cheeks to spread the powder thinly.

Also, yet another object of the present invention is to provide a makeup brush that allows even a general user not very adept in makeup skills to create a natural finish free from mottled appearance, making it possible for anyone of any skill level to wear makeup with a finish that normally requires gradation and other advanced makeup skills.

Means for Solving the Problems

The aforementioned objects of the present invention were achieved by the present invention in the form of a makeup brush having the following constitutions:

(1) A makeup brush for powder cosmetics having S strands and Z strands of synthetic fiber hair materials at its tip, wherein such makeup brush for powder cosmetics is characterized in that the twisting pitches of S strands and Z strands of the hair materials are 10 mm to 30 mm and, when the tip of the brush is deflected to trap the powder cosmetic to be contained in the brush tip part, the powder is evenly trapped over nearly the entire surfaces at the ends of brush hair materials.

(2) A makeup brush for powder cosmetics according to (1), characterized in that after the powder cosmetic has been trapped by moving the brush tip part in a circular motion, the powder is released and applied to the skin surface with the brush tip part again moved in a circular motion, where, even when the brush tip part is circled more than twice the number of times it was circled to trap the powder cosmetic, the powder cosmetic continues to be released from the brush tip part and applied to the skin surface and the applied condition of powder can be determined visually.

(3) A makeup brush for powder cosmetics according to (1) or (2), characterized in that, when the number of times the brush is circled for trapping is given as N1 and number of times it is circled for application is given as N2, the powder continues to be released from the brush tip part and applied to the skin surface and the applied condition of powder can be determined visually even in a range of $4 \geq N2/N1 > 3$.

(4) A makeup brush for powder cosmetics according to any one of (1) to (3), characterized in that, when the powder is applied by moving the tip of the makeup brush for powder cosmetics in a circular motion, the applied condition of powder when the brush is circled either clockwise or counterclockwise, and the applied condition when the brush is circled in the reverse direction of either counterclockwise or clockwise, are roughly equivalent.

(5) A makeup brush for powder cosmetics according to any one of (1) to (4), characterized in that the S strands and Z strands of synthetic fiber hair materials are positioned adjacent to each other and the S strands of hair materials and Z strands of hair materials are mixed at a ratio of 40:60 to 60:40 in quantity.

(6) A makeup brush for powder cosmetics according to any one of (1) to (5), characterized in that the synthetic fiber hair materials have tensile characteristics of 20 cN/dtex to 40 cN/dtex in initial modulus and 35% to 95% in rate of recovery after 20% stretching.

(7) A makeup brush for powder cosmetics according to any one of (1) to (6), characterized in that the boiling water contraction ratio of the synthetic fiber hair materials is 5% to 15%.

(8) A makeup brush for powder cosmetics according to any one of (1) to (7), characterized in that the synthetic fiber hair materials are made of at least one type of fiber selected from a group that includes polytrimethylene terephthalate (PTT) fiber and polybutylene terephthalate (PBT) fiber.

(9) A makeup brush for powder cosmetics according to any one of (1) to (8), characterized in that the synthetic fiber hair materials are tapered and have fine irregularities on their surface.

(10) A makeup brush for powder cosmetics according to any one of (1) to (9), characterized in that the makeup brush for powder cosmetics is a face brush, cheek brush, highlight brush, or eye shadow brush.

Effects of the Invention

According to the makeup brush for powder cosmetics proposed by the present invention, whose tip is constituted by a bundle of hair materials having an appropriate level of flexibility and elasticity that are also a mixture of S strands (right strands) and Z strands (left strands) representing hair materials twisted in opposite directions, gently pressing the brush tip part on the surface of powder cosmetic in a container to trap the cosmetic material causes the brush tip part to spread easily to allow for trapping of the powder cosmetic almost evenly over the entire surfaces at the ends of the spread brush tip part. Since the hair materials have an appropriate level of flexibility, they conform well to the skin during makeup application and even a person with sensitive skin can enjoy the soft, supple touch.

Because the brush tip part spreads easily, the cosmetic material is not picked up only in the areas around the center of the brush tip part, but the powder can be picked up evenly over nearly the entire surfaces at the ends of hair materials constituting the brush tip part. Accordingly, the cosmetic material applied to the skin surface does not form local clumps, but the cosmetic material can be thinly spread and applied on the skin surface, which makes the makeup brush ideal for creating a favorable finish, particularly suited for gradation.

In addition, the hair materials of the brush spread well when an external force is applied in a manner causing the brush tip part to deflect, thus allowing a sufficient amount of powder cosmetic to enter deep into the voids between hair materials. Since the powder cosmetic, once in the voids, is released little by little, the powder cosmetic can be spread evenly and thinly even in a face brush application where the powder must be applied widely over the skin surface, thus allowing for gradation over a wide area. The good powder containment property of the brush tip part eliminates the trouble of having to trap the cosmetic material repeatedly from its container and also ensures hygiene.

As mentioned above, a makeup brush for powder cosmetics is provided which, although using synthetic fibers, provides superior application performance equal to or even better than that of makeup brushes using animal hairs in wide circulation to date, and answers not only the needs of general consumers but also the high demands of makeup artists and other beauty professionals.

DESCRIPTION OF THE SYMBOLS

1 Handle part
2 Ferrule part
3 Brush tip part

MODE FOR CARRYING OUT THE INVENTION

The mode for carrying out the invention is explained specifically below.

Figure 1:
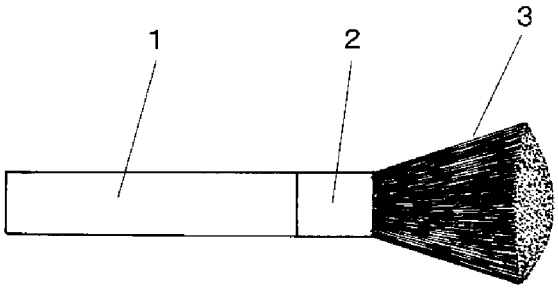
FIG. 1 Concept drawing showing the member structure of a makeup brush for powder cosmetics conforming to the present invention.

The makeup brush for powder cosmetics proposed by the present invention comprises a handle part, ferrule part (member for coupling and securing the brush tip part with the handle part), and brush tip part, in this order as seen from the side of the brush grasped by a hand, as illustrated in FIG. 1. The member structure, form and size of the brush are not limited to the structure in FIG. 1, and any brush shape or geometrical shape can be adopted.

Also, the handle part and ferrule part can be made as a single member if the brush must be small enough to be stored in a compact container.

Furthermore, the "brush tip part" under the present invention refers to the part constituted by a bundle of brush hair materials corresponding to the apical end side of the ferrule part, useful for picking up and trapping a powder cosmetic from its container and for releasing and thus applying the picked-up powder cosmetic onto the skin surface.

A makeup brush for powder cosmetics is used by sweeping the tip of the brush back and forth along straight lines on the surface of cosmetic material to trap the powder cosmetic, or by sweeping it in a circular motion to trap the powder cosmetic. Either way, the hair materials at the brush tip part deflect and spread outward and the powder cosmetic is trapped in the brush tip part.

Thus the powder cosmetic is trapped over the entire surfaces at the ends of hair materials, but it also enters and is retained in the voids formed between the hair materials that in turn form the brush tip part.

As the trapped powder is applied by sweeping the brush tip part over the skin surface along straight lines or in a circular motion, the powder attached to the ends of hair materials is released and then the brush tip part spreads again, thereby allowing the powder that has entered and been retained in the voids between hair materials to move little by little toward the ends of the brush tip part to be released and applied to the skin surface.

The hair materials used to form the tip of the makeup brush proposed by the present invention are made of synthetic fiber filaments that are twisted themselves, constituting a so-called spiral structure of "S strands (right strands)" and "Z strands (left strands)" of hair materials that spread three-dimensionally in the directions orthogonal to the spiral axis, unlike straight fibers.

The volume occupied by one twisted hair material having such spiral structure is greater than that of a flat hair material of zigzag structure as formed by the gear crimping method, and the brush tip part constituted by an aggregate of twisted-type hair materials is bulkier, even in a stored state, because the hair materials are prevented from overlapping or contacting with one another and thus there are many internal voids.

On the other hand, during makeup application the brush tip part is pressed against an object to apply an external force in a manner causing the hair materials to deflect, and the hair materials at the brush tip part spread easily in a fan shape without tangling. Because of this effect, the powder cosmetic is gathered and trapped over the entire area of the spread brush tip part in contact with the cosmetic material, and the powder is stored deep in the voids between hair materials. Because sufficient space is formed between the hair materials and retained while the brush is in use, preferably, by mixing roughly equal quantities of S strands of hair materials and Z strands of hair materials at the brush tip part in a manner adjacent to each other, the effects where overlapping and entanglement of hair materials is inhibited and a sufficient amount of powder is retained at the brush tip part and released gradually as the powder is applied, are exhibited in a more prominent manner.

The twisted structure of the hair materials forming the tip of the makeup brush proposed by the present invention is such that S strands (right strands) of synthetic fiber hair materials whose twisting pitch is in a range of 10 mm to 30 mm, and Z strands (left strands) of synthetic fiber hair materials whose twisting pitch is in a range of 10 mm to 30 mm, are mixed in a manner causing the hair materials to lie parallel to each other, and then bundled to form the brush tip part.

The twisted fibers are bent in waves at specific regular frequencies (wavelengths) in plan view, where the length corresponding to one wavelength is called the "pitch." The twisted synthetic fiber structure can be formed using any known manufacturing method such as the twisting method.

With the makeup brush proposed by the present invention, its effects manifest in a more prominent manner when the tip of the brush is swept repeatedly in a circular motion as a powder cosmetic is "trapped" or picked up from its container to the tip of the brush and also as the powder cosmetic that has been picked up or trapped in the brush tip part is applied and spread on the skin surface.

When the brush proposed by the present invention is swept, or when the brush tip part is moved in circular motion, the bundle of hair materials constituting the brush tip part receives an external force that "twists" each hair material according to the circular motion.

When the ends of the brush tip part are observed as this is happening, clearly they are moving just like swirls formed on a water surface attracting objects. On the other hand, the hair materials, which have an appropriate level of elasticity and ability to restore their shape after having been deformed under a twisting or other external force, become twisted and restore their shape repeatedly while the brush tip part is circling, causing the powder to be moved, as if being suctioned, deep into the voids between hair materials from the surface of the brush tip part. Additionally because the hair materials are twisted, some powder moves from the ends of brush hair materials toward their bases along the hair materials while the brush tip part is circling, as if it is engaged with a screw in line with the movement of the entire bundle of hairs.

When the powder cosmetic trapped on the brush is applied and spread on the skin surface, the brush tip part is swept while in contact with and deflecting on the skin surface, so that the brush tip part spreads and thus the powder stored in the voids is released little by little toward the ends. Also when the brush tip part is swept on the skin surface in circular motion to apply makeup on the cheeks, etc., the powder moves gradually outward from deep inside the brush tip part as if it is squeezed out, which is the opposite of what happens when the powder is trapped.

The tip of the brush is crimped by the ferrule part at the base on the handle part side of the brush, so it is narrower at the base (handle part size) than at the tip end. Accordingly, trapped powder moves easily from the wider end to the narrower end of the brush tip part, or from the ends of the brush tip part to the base. When the powder is released for application, on the other hand, it is released by a small amount at a time instead of all at once, because the powder retained on the narrower end of the brush tip part remains restricted by the gaps between hair materials as it moves. Since the brush hair materials are constituted by a mixture of S strands and Z strands of hair materials, the hair materials do not overlap or contact each other at the base, which leads to excellent powder containment property.

From the aforementioned viewpoints, flexibility of synthetic fiber hair materials forming the brush tip part, as well as their restorability after deformation due to external force, are important factors. For this reason, desirable tensile characteristics can be specifically illustrated by the initial modulus in the tensile test in the case of flexibility (rigidity) of synthetic fiber hair materials, which is preferably in a range of 20 cN/dtex to 40 cN/dtex, or more preferably in a range of 20 cN/dtex to 30 cN/dtex. As long as the initial modulus is in these ranges, the hair materials deflect and make it easy for the brush tip part to spread and trap the powder over the entire surfaces at the ends of hair materials and for the powder to enter deep into the brush tip part, when the brush tip part is pressed against or swept in a circular motion on the surface of powder cosmetic stored in its container. Also when the powder is applied, excellent powder containment property is ensured because the powder stored deep inside is released gradually. Furthermore, the brush tip part feels as soft as animal hairs, allowing the user to enjoy a smooth touch during makeup application.

Also, it is appropriate that synthetic fiber hair materials that deflect or become twisted and thus deform while the brush is in use recover to their original shape quickly once the external force is removed. Restorability after deformation can be expressed by the rate of recovery after 20% stretching in the tensile test, where it is appropriate that the rate of recovery is in a range of 35% to 95%, or preferably in a range of 40% to 90%. Use of hair materials whose characteristics fall within these ranges is desirable because it not only makes it easier for the powder to enter the brush as the powder cosmetic is trapped, but it also makes the brush more durable against repeated uses.

In addition, the thickness of one synthetic fiber hair material should be preferably 0.02 mm to 0.2 mm or so, or more preferably 0.05 mm to 0.15 mm or so, from the viewpoint of ease of forming the brush, its feel on the skin, and cosmetic trapping property.

From the viewpoint of practical characteristics of the bush proposed by the present invention, we can use an example of moving the brush tip part in circular motion. When cosmetic material is trapped, the powder moves from the ends of hair materials toward the handle part side and is stored therein as the hair materials are twisted, as explained above. Then, when the stored powder cosmetic is applied to the skin surface, not all powder is released at once, but instead the powder stored deeper in the brush tip part moves more slowly toward the ends of the brush tip part and is transferred onto the skin surface. Accordingly, the powder is still released and applied to the skin surface even when the brush tip part is circled when applying the powder more than twice the number of times it was circled when trapping the powder.

Because S strands of hair materials and Z strands of hair materials are used by roughly equal quantities and mixed evenly in a manner causing them to lie adjacent to each other, the hair materials are prevented from contacting each other and, regardless of whether the brush tip part is circled in a clockwise direction or counterclockwise direction as the powder cosmetic is trapped and released (i.e., the cosmetic material is applied to the skin surface), the makeup will have an identical finish without creating any difference depending on whether the brush tip part was circled clockwise or counterclockwise when trapping and releasing the powder.

Because of this good balance of clockwise/counterclockwise motions, the makeup brush proposed by the present invention has the advantage of allowing both right-handed users and left-handed users to apply makeup with a desired finish.

When the tip of the makeup brush proposed by the present invention is used to trap or pick up powder cosmetic from its container, and spread and apply the powder cosmetic onto the face, the hair materials deflect from their original shape as the brush tip part receives a pressuring force or twisting force and therefore cause the brush tip part to spread, and once the pressuring force is removed the hair materials restore their original shape, and this cycle of deformation and recovery is repeated. Accordingly, the powder is trapped in the voids between hair materials and gradually released from inside the brush tip part according to the application motion on the skin surface.

Mixing of roughly equal quantities of S strands and Z strands of synthetic fiber hair materials in a manner causing them to lie adjacent to each other prevents the hair materials from tangling with each other even when such cycle is repeated with every use because adjacent hair materials are twisted in opposite directions, which is desirable in that the best powder containment property can be maintained at all times. In addition, such structure prevents tangling of hair materials in a sustained manner despite repeated use of the brush for an extended period of time, resulting in improved durability of the brush.

If S strands of hair materials concentrate in certain areas, on the other hand, these hair materials twisted in the same direction may overlap and tangle with each other during makeup application.

The same goes when Z stands of hair materials lie adjacent to each other. Accordingly, a structure where S strands and Z strands of synthetic fiber hair materials are mixed evenly in a manner lying adjacent to each other is preferable.

Also based on this structure, the tip of the brush receives little restriction from tangled hair materials when it is pressed against each surface as powder cosmetic is trapped from its container or trapped cosmetic material is applied and spread over the skin surface, thereby allowing the brush tip part to spread easily and trap the powder cosmetic almost evenly over the entire ends of hair materials constituting the brush tip part and also deep into the voids between the hair materials constituting the brush tip part. This way, when the powder cosmetic is applied to the skin surface the cosmetic material can be spread thinly without creating a mottled appearance, while the good powder containment property allows the powder to be released little by little from the inside to the surface of the brush tip part and thereby eliminates the trouble of having to return the brush to the container to trap the cosmetic material repeatedly. As a result, gradation can be performed with ease.

There are no specific makeup methods in which a makeup brush should be used, but largely a makeup brush is used by sweeping it on the skin surface roughly along straight lines to spread the powder in the T zone, over the eyelids, around the eyes, etc., or by moving the brush tip part in circular motion to spread the powder to accentuate the cheeks. The effects of the present invention can be achieved in the trapping and releasing processes regardless of whether the former method or latter method is used, but the effects are more prominent when makeup is applied with the brush used by the latter method.

Particularly under the latter method, the handle part of the brush is held by a hand and operated so that the brush tip part slides over the skin surface as if to roughly draw circles, where the brush tip part constituted by a mixture of S strands of hair materials and Z strands of hair materials does not make any recognizable difference in result between clockwise circular motion and counterclockwise circular motion and ensures a very favorable finish free from any influence of a specific way in which the user holds the brush. As for the possibility of the hair materials permanently twisted in the same direction in which the brush is circled repeatedly in such makeup method, the layout of S strands of hair materials and Z strands of hair materials in a manner allowing them to lie adjacent to each other is convenient in that such permanent twisting of hair materials does not occur easily and the durability of the brush improves further.

For the aforementioned reason, preferably the mixing ratio of S strands of hair materials and Z strands of hair materials in the brush proposed by the present invention represents equal or close-to-equal quantities of both. The mixing ratio of [S strands of hair materials]:[Z strands of hair materials] is preferably in a range of 40:60 to 60:40, or more preferably in a range of 45:55 to 55:45, based on a ratio of quantities.

The twisting pitch of hair materials used for the tip of the brush proposed by the present invention is set in a range of 10 mm to 30 mm, both for S strands and Z strands, from the viewpoints of ensuring manufacturability and forming powder-retaining space between the hair materials to retain powder while the brush is in use.

A pitch less than 10 mm is undesirable in terms of manufacturability because tighter twisting causes the hair materials to tangle easily and makes it difficult to separate the hairs in the fiber opening step after twisting and when the hair materials are bundled to form the brush tip part. Also, tightly twisted hair materials tend to become firm and feel hard on the skin.

A pitch exceeding 30 mm, on the other hand, does not present manufacturability problems, but loose twisting results in the hair materials extending almost straight and spreading little three-dimensionally, thereby reducing voids between hair materials, which in turn may cause the amount of powder cosmetic trapped and retained therein to diminish. The twisting pitch is desirably in a range of 11 mm to 25 mm, or most desirably in a range of 12 mm to 20 mm.

In addition, the mixed S strands and Z strands of hair materials can have the same twisting pitch, or hair materials of different pitches in a range of 10 mm to 30 mm can be mixed.

Furthermore, while the hair materials used for the tip of the brush proposed by the present invention are bent in waves in plan view, preferably their amplitude is 0.5 mm to 1.5 mm or so from the viewpoints of powder trapping and releasing properties.

The S strands of hair materials and Z strands of hair materials used under the present invention can be manufactured by any means known in the field of fiber processing, but preferably the boiling water contraction ratio of synthetic fiber filaments constituting the hair materials is set between 5% and 15% in order to facilitate twisting them at a pitch in a range of 10 mm to 30 mm while thermally fixing them to prevent untwisting and thus ensuring durability. A more preferred range of boiling water contraction ratio is 6% to 12%. When the boiling water contraction ratio falls in this range, the hair materials can be thermally fixed with ease to prevent untwisting, and they can also be handled easily in the brush forming step. Also in terms of usability, the hair materials can demonstrate their characteristics fully and their durability can be improved. To achieve these effects, the spinning/extending conditions can be controlled and set as deemed appropriate in the original yarn manufacturing step.

For the synthetic fiber material to form hair materials, any one type can be selected or two or more types can be selected and combined from among polyamide fiber, polyolefin fiber, polyacrylonitrile fiber, polyester fiber and other representative synthetic fibers, of which polyester has an appropriate level of rigidity and durability for use as brush hair materials and also offers excellent post-processability such as twisting and tapering.

Among polyester fibers, polybutylene terephthalate (PBT) fiber and polytrimethylene terephthalate (PTT) fiber have an appropriate level of flexibility and elasticity and therefore are best suited for hair materials. Of the two, PTT fiber is the more preferred choice because the unique molecular structure of polytrimethylene terephthalate provides excellent flexibility and deformation recoverability desirable for brush hair materials.

For example, from the viewpoint of touch on the skin, PBT fiber and PTT fiber are less rigid variants of polyester fibers than PET (polyethylene terephthalate) fiber and therefore feel soft and supple when pressed against the skin. These fibers also exhibit excellent restorability after deformation due to external force, which makes them particularly ideal for use as brush hair materials. More preferably the ends of hair materials are tapered, as mentioned above, to create even a softer touch on the skin. PBT fiber and PTT fiber are particularly favorable in this context because they can be tapered by alkali treatment with ease and also permit formation of fine irregularities on the surface of tapered fibers for better retention of fine powder. Preferably the concave parts of these irregularities are kept in a range of approx. 1 to 25 μm or so in size, as it matches the range of sizes of powder particles widely used in the field of powder cosmetics. Such irregularities at the end of each hair material not only improve the powder cosmetic trapping property, but they also contribute to the controlling of powder releasing property when the powder is applied, ensuring performance equivalent to that of brushes made of squirrel hair or other animal hair traditionally used as premium products.

Powder releasing property, which is one key performance of the makeup brush for powder cosmetics proposed by the present invention, is explained specifically using the brushes of Example 1 and Comparative Example 1 according to the actual method of use of sweeping the brush tip part in a circular motion.

Figure 4:
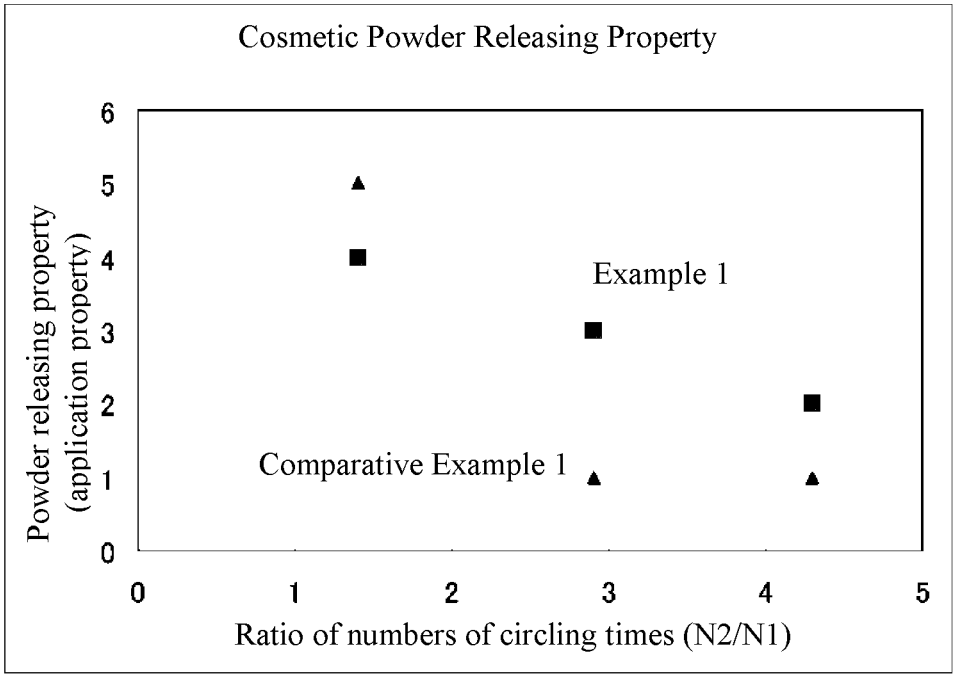
FIG. 4 This is a graph showing model test results on powder releasing property of a makeup brush for powder cosmetics conforming to the present invention (showing the powder releasing property when a powder cosmetic is trapped and applied by moving the brush tip part in circular motion).

FIG. 4 is a graph showing the powder releasing property (condition of application to the skin surface) when the brush tip part is circled N1 times to trap the powder and then circled N2 times in the same rotating direction without any new powder being replenished. Because the amount of powder released from the brush tip part is applied to the skin surface, the released amount is equivalent to the applied amount. In this evaluation, the diameter of the circle drawn in the trapping process is equivalent to the diameter of the circle drawn in the releasing process.

In this graph, the X-axis takes the value calculated by dividing the number of times the brush is circled in the releasing (cosmetic material application) process by the number of times it is circled in the trapping (cosmetic material pickup) process. On the other hand, the Y-axis is a numerical representation of the condition of powder being released and applied onto the skin based on a five-point scale.

In the figure, a greater X-axis value means more circling in the releasing process, which in turn leads to a smaller amount of released powder and consequently a smaller amount applied to the skin surface; hence, the graph line trends downward to the right. This indicates that, the more gradual the downward slope of the graph line, the better the powder retention property or, in other words, powder containment property at the brush tip part becomes.

As shown in FIG. 4, the brush proposed by the present invention still releases the powder from its tip to be applied to the skin surface even when N2/N1 is in a range exceeding 2, or preferably exceeding 3. In other words, N2/N1=4 means that the powder is still released even when the brush is circled four times more than that circled in the trapping process and that application of this amount is visually identifiable. As long as this range is met, transfer of the powder cosmetic onto the skin surface can be visually determined. The makeup brush proposed by the present invention has a characteristic of being able to gradually release the trapped powder, so powder application to the skin surface is possible and applied condition is visually clearly identifiable even in a range of $4 \geq N2/N1 > 3$.

It should be noted that, although air-dried white tissue paper is used in this model evaluation instead of skin surface for easy determination of applied condition, the same result as obtained by this model evaluation is achieved even when the powder cosmetic is applied to a real skin surface such as a face surface as long as the powder cosmetic used has a color different from the skin color. The value of N1 is not limited in any way, but 2 to 10 times or so is appropriate so that sufficient powder can be contained in the brush tip part.

From the viewpoint of brush manufacturing step, any known manufacturing method can be used. However, a method involving adsorption or fixing of a surface treatment agent such as silicon compound and/or quaternary amine compound over the synthetic fiber hair materials constituting the brush tip part is particularly preferable because it improves the ease of separation of hairs and also improves their smoothness during use.

It is also possible to add an antistatic agent, antibacterial agent, etc., to the fiber surface using any known method.

Cosmetic materials that are suitable for the makeup brush for powder cosmetics proposed by the present invention are not specifically limited, but examples include face powder, cheek color, powder foundation, highlight/shade, and other face colors, among others, where these cosmetic materials of approx. 0.1 to 30 μm in particle size can be used favorably.

According to the makeup brush for powder cosmetics proposed by the present invention, the brush hair materials are soft and can structurally form enough voids to store a sufficient amount of powder between the hair materials, so even when the hair materials repeat the cycle of deflection and recovery many times when trapping and applying the cosmetic material, the powder that has entered the brush tip part does not dissipate easily and therefore the problem of lost cosmetic material such as scattered powder can be prevented.

The makeup brush for powder cosmetics proposed by the present invention is suitable for so-called "gradation," which is a method of use where powder cosmetic is thinly spread and applied onto the skin surface, as described above.

Also, the makeup brush for powder cosmetics proposed by the present invention demonstrates its excellent characteristics even when used as a face brush, cheek brush, highlight brush, or eye shadow brush often used with this method.

EXAMPLES

Next, an example of manufacturing a makeup brush for powder cosmetics conforming to the present invention, and example of characteristics evaluation using this makeup brush for powder cosmetics, are explained below in detail.

(Manufacturing Example of Makeup Brush)

Polytrimethylene terephthalate (PTT) monofilaments having a twisting pitch of 16 mm and exhibiting strand characteristics, and of 80 μm in diameter, were used as hair materials, and S strands and Z strands of such hair materials were mixed by an equal quantity of 7,000 strands each in a manner causing them to lie adjacent to each other, and the mixed strands were cut to form a bundle (of 4.5 cm in diameter and 8 cm in length).

One end of this bundle was soaked in a treatment liquid containing 100 g/liter of sodium hydroxide and 6 g/liter of quaternary amine (DYK-1125 manufactured by Ipposha Oil Industries) and treated for 130 minutes at 130° C. to add tapering.

The tapered bundle was put in a brush-tip forming jar and shaken to form a brush tip part with a raised center conforming to the internal shape of the jar.

The formed brush tip part was inserted into a cylindrical ferrule part provided at the tip of a brush handle part and the ferrule part was crimped to produce a brush. The outer diameter dimension of the crimped ferrule part was 18 mm. Also, the enveloping surface formed by the ends of hair materials was roughly a sphere having a raised center.

(Usability Evaluation of Brush)

(Trapping Property)

The tip of the makeup brush manufactured in the aforementioned manufacturing example was swept clockwise on the surface of the cheek-color cosmetic material "Simon Pure" (manufactured by Shiseido) which is a powder cosmetic having a slight red color, seven times (N1) in a circular motion as if to draw a circle (5 cm in diameter), to trap the powder cosmetic and pick up the powder at the ends of the brush tip part. The distribution condition of this powder was observed to evaluate the trapping property.

(Powder Releasing Property)

Using the brush with the powder cosmetic trapped at its tip according to the aforementioned method, the brush tip part was swept clockwise 10 times (N2=10) in a circular motion as if to draw a circle on the surface of a skin surface model made of a piece of white tissue paper within a circle of 5 cm in diameter, and the condition of the area of tissue paper in which the powder cosmetic was applied was compared against the background area in which no powder cosmetic was applied, based on visual observation.

Next, the same brush was used and, without replenishing powder cosmetic, the brush tip part was further swept clockwise 10 times (N2=20 (cumulative value)) in a circular motion as if to draw a circle on the surface of a new, different piece of white tissue paper of the same material within a circle of 5 cm in diameter, and the applied condition was compared and observed in the same manner as explained above.

Furthermore, the same brush was used and, without replenishing powder cosmetic, the brush tip part was further swept 10 times (N2=30 (cumulative value)) in a circular motion and the applied condition was compared and observed in the same manner as explained above.

Example 1

Using the makeup brush for powder cosmetics manufactured in the above manufacturing example, its trapping property (pickup property) and powder releasing property (powder containment property) were evaluated according to the brush usability evaluation methods described above, the results of which are shown in Table 1.

Figure 2A:
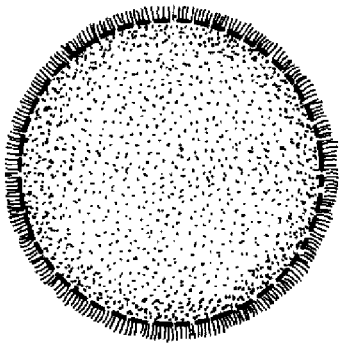
FIG. 2A This is a top view of the tip of a makeup brush for powder cosmetics conforming to the present invention (quantity of S strands of hair materials/quantity of Z strands of hair materials=50/50) in which a powder cosmetic is trapped, showing the condition of the powder being attached (showing how the powder is attached evenly over the entire areas at the ends of hair materials as shown by the broken line).
Figure 2B:
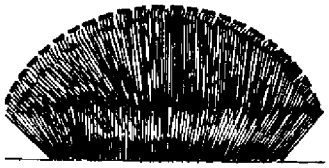
FIG. 2B This is a side view of the ends of the tip of a makeup brush for powder cosmetics conforming to the present invention (quantity of S strands of hair materials/quantity of Z strands of hair materials=50/50) in which a powder cosmetic is trapped, showing the condition of the powder being attached (showing how the powder is attached evenly over the entire areas at the ends of hair materials as shown by the broken line).

The evaluation results of trapping property are shown in FIG. 2A and FIG. 2B.

As is evident from the figures, the trapped powder cosmetic was picked up evenly over the entire ends of hair materials forming the brush tip part.

As for powder releasing property, on the other hand, clearly the powder was still released and applied to the skin surface even when N2/N1 exceeded 4, as shown in FIG. 4 (indicated by ■). This confirms that the brush tip part provides good powder containment property and has a characteristic to gradually release the powder at the time of application.

Comparative Example 1

Using a makeup brush for powder cosmetics manufactured according to the above manufacturing example but using PBT hair materials and based on the gear crimping method with a pitch of 16 mm, its trapping property and powder releasing property (powder containment property) were evaluated according to the brush usability evaluation methods described above.

Figure 3A:
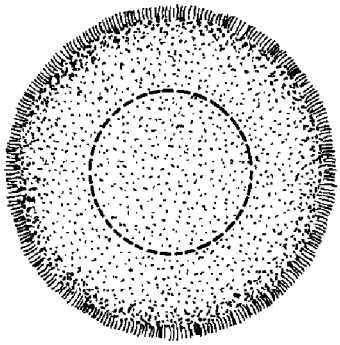
FIG. 3A This is a top view of the tip of a conventional makeup brush for powder cosmetics (based on the gear crimping method using two-dimensionally crimped hair materials) in which a powder cosmetic is trapped, showing the condition of the powder being attached (showing how the powder is attached only in the area enclosed by the broken line).
Figure 3B:
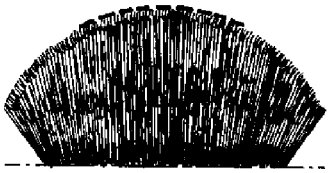
FIG. 3B This is a side view of the ends of the tip of a conventional makeup brush for powder cosmetics (based on the gear crimping method using two-dimensionally crimped hair materials) in which a powder cosmetic is trapped, showing the condition of the powder being attached (showing how the powder is attached only in the area enclosed by the broken line).

The evaluation results of trapping property are shown in FIG. 3A and FIG. 3B. As is evident from the figures, the trapped powder cosmetic was picked up only in limited areas around the center of the brush tip part.

As for powder releasing property, on the other hand, the powder was no longer released and could not be applied to the skin surface when N2/N1 exceeded 2, as shown in FIG. 4 (indicated by ▲). This confirms that the brush tip part provides poor powder containment property and has a characteristic to quickly release the powder at the time of application.

The evaluation results of Examples 2 to 5 and Comparative Examples 2 to 5 described below are also shown in Table 1.

Examples 2 to 5

Using the hair materials corresponding to those of Examples 2 to 5 as shown in Table 1, makeup brushes were manufactured based on the corresponding twisting characteristics and quantity ratios of S strands of hair materials/Z strands of hair materials, respectively.

The usability of each of these brushes was evaluated according to the evaluation methods for powder trapping property and powder releasing property mentioned above, to obtain the evaluation results shown in Table 1. With all brushes, the powder was picked up roughly uniformly over the entire surfaces at the ends of hair materials constituting the brush tip part, indicating excellent trapping property. Excellent powder containment property and gradual releasing of powder were also confirmed.

These evaluation results show that the makeup brushes for powder cosmetics conforming to the present invention demonstrated excellent powder cosmetic trapping property and picked up the powder uniformly over the entire surfaces at the ends of the brush tip part. They also exhibited very good powder containment property and had a characteristic to gradually release the powder, confirming their suitability particularly for the gradation technique of thinly spreading the powder cosmetic.

Comparative Examples 2 to 5

Using the hair materials corresponding to those of Comparative Examples 2 to 5 as shown in Table 1, makeup brushes were manufactured based on the corresponding twisting characteristics and quantity ratios of S strands of hair materials/Z strands of hair materials, respectively.

The usability of each of these brushes was evaluated according to the evaluation methods for trapping property and powder releasing property mentioned above, to obtain the evaluation results shown in Table 1. As for trapping property, all brushes exhibited uneven trapping, not uniform trapping, and with respect to powder releasing property, the powder was not trapped deep into the brush tip part and was therefore released too quickly, resulting in poor usability because the brush had to be returned frequently into the container to trap the cosmetic material in order to cover the face.

[Overall Summary of Results]

In all of Examples 1 to 5, the hair materials did not tangle and could be separated and handled with ease in the brush manufacturing step when the twisting pitch was in a range of 10 mm to 30 mm.

The makeup brushes having a brush tip part obtained by mixing S strands of hair materials and Z strands of hair materials of pitches in the aforementioned range according to the quantity ratios shown in Table 1, could trap the powder cosmetic evenly over the entire surfaces at the ends of hair materials regardless of whether the hair materials were constituted by PTT or PBT, indicating excellent trapping property. On the other hand, the model evaluation of releasing property found that, with all of Examples 1 to 5, the powder was released and applied to the skin surface when N2/N1 was in a range exceeding 3 but no more than 4 at most. As a result, even unskilled users could perform the so-called gradation technique of thinly spreading the powder cosmetic with ease.

On the other hand, use of hair materials whose pitch was less than 10 mm caused the hair materials to tangle at times and the manufacturability was not necessarily good, as shown in Comparative Example 4. When the pitch exceeded 30 mm, on the other hand, handling was easy but the brush tip part did not spread readily when in use, resulting in the powder trapped only in limited areas and being released poorly.

Also when the hair materials obtained by the gear crimping method and having flatter crimps were used, the powder was trapped only in limited areas and released in early stages, resulting in poor application performance, as shown in Comparative Example 1.

Additionally when the brush tip part comprised only S strands of hair materials or Z strands of hair materials, the powder was trapped only in limited areas and released quickly, resulting in poor application performance, as shown in Comparative Examples 2 and 3.

Comparison of Application Property Between Counterclockwise Motion and Clockwise Motion

Example 6

Using a brush manufactured according to the method explained in Example 1, usability evaluation of trapping property and powder releasing property was performed according to the same evaluation methods for trapping property and powder releasing property, except that the brush tip part was circled in a counterclockwise direction.

When the area in which the powder was applied in the counterclockwise motion was compared to the area in which the powder was applied in a clockwise motion, no difference was found between the two.

Example 7

Furthermore, a brush manufactured according to the conditions explained in Example 2 was used to comparatively evaluate the trapping property and powder releasing property between a counterclockwise motion and a clockwise motion in the same manner as descried above, but no difference was found between the two.

As explained above, the makeup brushes for powder cosmetics conforming to the present invention, in which Z strands and S strands of brush hair materials were arranged roughly uniformly, presented no difference in usability between a counterclockwise motion and a clockwise motion and allowed even unskilled users to achieve makeup of a good finish with ease.

TABLE 1

Evaluation of Examples and Comparative Examples

| | No. | | | | | | | | | |
|---|---|---|---|---|---|---|---|---|---|---|
| | Example 1 | Example 2 | Example 3 | Example 4 | Example 5 | Comparative Example 1 | Comparative Example 2 | Comparative Example 3 | Comparative Example 4 | Comparative Example 5 |
| Fiber material | PTT | PBT | PTT | PTT | PTT (S strands)/PBT (Z strands) | PBT | PTT | PTT | PTT | PTT |
| Crimp structure | Twisted structure | Twisted structure | Twisted structure | Twisted structure | Twisted structure | Gear crimping | Twisted structure | Twisted structure | Twisted structure | Twisted structure |
| Wavelength (mm) | 16 | 16 | 10 | 30 | 20 | 16 | 16 | 16 | 8 | 35 |
| S strands/Z strands (in quantity) | 50/50 | 60/40 | 50/50 | 50/50 | 40/60 | 50/50 | 100/0 | 0/100 | 50/50 | 50/50 |
| Ease of hair separation | Good | Good | Good | Good | Good | Good | Good | Good | Slightly difficult | Good |
| Powder trapping property | ○ | ○ | ○ | ○ | ○ | X | Δ~X | Δ~X | Δ | X |
| Powder releasing property | ⊙ | ○ | ⊙ | ⊙ | ○ | X | Δ | Δ | Δ | Δ~X |

Powder trapping property ○: Powder can be trapped evenly over the entire surfaces at the ends of hair materials. Δ: Powder may be trapped in mottled patterns. X: Powder is trapped only in limited areas around the center of the brush tip part.

Powder releasing property ⊙: Powder is released and its applied condition is visually identifiable even when [N2/N1] exceeds 4. ○: Powder is released and its applied condition is visually identifiable even when [N2/N1] exceeds 3. (Visual identification is sometimes difficult if it exceeds 4.) Δ: Not much powder is released and identification of applied condition is sometimes difficult when [N2/N1] exceeds 2. X: Hardly any powder is released and identification of applied condition is impossible when [N2/N1] exceeds 2.

What is claimed is:

1. A makeup brush for powder cosmetics having S strands and Z strands of synthetic fiber hair materials at its tip, said makeup brush for powder cosmetics characterized in that wherein twisting pitches of S strands and Z strands of the hair materials are 10 mm to 30 mm and when the tip of the brush is deflected to trap the powder cosmetic to be contained in the brush tip part, the powder is evenly trapped over nearly entire surfaces at ends of brush hair materials, wherein the synthetic fiber hair materials are tapered by alkali treatment such that fine irregularities are chemically created on surfaces of the tapered hair materials, and said synthetic fiber hair materials have tensile characteristics of 20 cN/dtex to 40 cN/dtex in initial modulus and 35% to 95% in rate of recovery after 20% stretching.

2. A makeup brush for powder cosmetics according to claim 1, characterized in that after the powder cosmetic has been trapped by moving the brush tip part in a circular motion, the powder is released and applied to a skin surface with the brush tip part again moved in a circular motion, where, even when the brush tip part is circled more than twice the number of times it was circled to trap the powder cosmetic, the powder cosmetic continues to be released from the brush tip part and applied to the skin surface and the applied condition of powder can be determined visually.

3. A makeup brush for powder cosmetics according to claim 1, characterized in that, when a number of times the brush is circled for trapping is given as N1 and number of times it is circled for application is given as N2, the powder continues to be released from the brush tip part and applied to the skin surface and the applied condition of powder can be determined visually even in a range of $4 \geq N2/N1 > 3$.

4. A makeup brush for powder cosmetics according to claim 1, characterized in that, when the powder is applied by moving the tip of the makeup brush for powder cosmetics in a circular motion, the applied condition of powder when the brush is circled either clockwise or counterclockwise, and the applied condition when the brush is circled in a reverse direction (either counterclockwise or clockwise), are roughly equivalent.

5. A makeup brush for powder cosmetics according to claim 1, characterized in that the S strands and Z strands of synthetic fiber hair materials are positioned adjacent to each other and the S strands of hair materials and Z strands of hair materials are mixed at a ratio of 40:60 to 60:40 in quantity.

6. A makeup brush for powder cosmetics according to claim 1, characterized in that a boiling water contraction ratio of the synthetic fiber hair materials is 5% to 15%.

7. A makeup brush for powder cosmetics according to claim 1, characterized in that the synthetic fiber hair materials are made of at least one type of fiber selected from a group that includes polytrimethylene terephthalate (PTT) fiber and polybutylene terephthalate (PBT) fiber.

8. A makeup brush for powder cosmetics according to claim 1, characterized in that the makeup brush for powder cosmetics is a face brush, cheek brush, highlight brush, or eye shadow brush.

9. A makeup brush for powder cosmetics according to claim 1, wherein concave parts of the irregularities of each hair material are formed in a range of 1 to 25 μm in size.

* * * * *